US006524146B2

(12) United States Patent
Spade et al.

(10) Patent No.: US 6,524,146 B2
(45) Date of Patent: Feb. 25, 2003

(54) WATERCRAFT HAVING AUXILIARY STEERING

(75) Inventors: Sam Spade, Palm Bay, FL (US); Normand Beauregard, Valcourt (CA); Richard Simard, St-Charles-de-Drummond (CA)

(73) Assignee: Bombardier Inc., Montreal (CA)

( * ) Notice: Subject to any disclaimer, the term of this patent is extended or adjusted under 35 U.S.C. 154(b) by 0 days.

(21) Appl. No.: 10/173,532

(22) Filed: Jun. 18, 2002

(65) Prior Publication Data

US 2002/0160669 A1 Oct. 31, 2002

Related U.S. Application Data

(63) Continuation of application No. 09/759,456, filed on Jan. 16, 2001, now abandoned, which is a continuation of application No. 09/088,854, filed on Jun. 2, 1998, now Pat. No. 6,174, 210.

(51) Int. Cl.[7] ..... B63H 11/11
(52) U.S. Cl. ..... 440/41; 114/284
(58) Field of Search ..... 440/41, 42, 47; 114/284, 285, 286, 287

(56) References Cited

U.S. PATENT DOCUMENTS

| | | | |
|---|---|---|---|
| 3,159,134 | A | 12/1964 | Winnen |
| 3,250,072 | A | 5/1966 | Smith |
| 3,272,171 | A | 9/1966 | Korcak |
| 3,327,671 | A | 6/1967 | Comins |
| 3,565,030 | A | 2/1971 | Curtis |
| 3,628,486 | A | 12/1971 | Bennett |
| 3,780,683 | A | 12/1973 | Doerffer et al. |
| 3,831,543 | A | 8/1974 | Hamasaki |
| 3,842,787 | A | 10/1974 | Giacosa |
| 3,906,885 | A | 9/1975 | Woodfill |
| 3,942,461 | A | 3/1976 | Smith |
| 3,943,876 | A | 3/1976 | Kiekhaefer |
| 3,949,700 | A | 4/1976 | Baroody |
| 3,976,026 | A | 8/1976 | Eastling |
| 3,982,493 | A | 9/1976 | Cronin |
| 3,982,494 | A | 9/1976 | Posti |
| 4,046,097 | A | 9/1977 | Hornung |
| 4,149,469 | A | 4/1979 | Bigler |
| 4,175,721 | A | 11/1979 | Lempa, Jr. |
| 4,232,626 | A | 11/1980 | Kern |
| 4,323,027 | A | 4/1982 | Schermerhorn |
| 4,352,666 | A | 10/1982 | McGowan |
| 4,355,985 | A | 10/1982 | Borst et al. |
| 4,463,700 | A | 8/1984 | Becker |
| 4,583,030 | A | 4/1986 | Nixon |
| 4,615,290 | A | 10/1986 | Hall |
| 4,632,049 | A | 12/1986 | Hall et al. |
| 4,749,926 | A | 6/1988 | Ontolchik |

(List continued on next page.)

FOREIGN PATENT DOCUMENTS

| | | |
|---|---|---|
| CA | 2207938 | 7/1998 |
| CA | 2270679 | 12/1999 |
| CA | 2271332 | 2/2000 |

OTHER PUBLICATIONS

Smith, Steve, *Hot Water*, vol. 5, No. 4, "Them's the Brakes," pp. 8, 51.

*Primary Examiner*—Jesus D. Sotelo
(74) *Attorney, Agent, or Firm*—Pillsbury Winthrop LLP

(57) ABSTRACT

A control mechanism for a watercraft includes a selectively movable flap connected to an actuator, which moves the flap into and out of the flow of water to affect steering, deceleration and trimming. The flap is recessed with respect to the lower surface of the hull so that it does not create drag at high speeds. The flap may be a portion of the ride plate, may be disposed in a recess in the bottom of the hull, or may be disposed on the stern above the bottom of the hull.

23 Claims, 14 Drawing Sheets

U.S. PATENT DOCUMENTS 4,759,732 A 7/1988 Atsumi
4,762,079 A 8/1988 Takeuchi et al.
4,776,205 A 10/1988 Brooks et al.
4,776,295 A 10/1988 Kline et al.
4,779,553 A 10/1988 Wildhaber, Sr.
4,787,867 A 11/1988 Takeuchi et al.
4,854,259 A 8/1989 Cluett
4,908,766 A 3/1990 Takeuchi
4,949,662 A 8/1990 Kobayashi
4,961,396 A 10/1990 Sasagawa
4,964,821 A 10/1990 Tafoya
4,967,682 A 11/1990 O'Donnell
5,062,815 A 11/1991 Kobayashi
5,070,803 A 12/1991 Smith
5,085,603 A 2/1992 Haluzak
5,092,260 A 3/1992 Mardikian
5,094,182 A 3/1992 Simner
5,113,777 A 5/1992 Kobayashi
5,154,650 A 10/1992 Nakase
5,167,547 A 12/1992 Kobayashi et al.
5,193,478 A 3/1993 Mardikian
5,199,913 A 4/1993 Toyohara et al.
5,246,392 A 9/1993 Johnston
5,254,023 A 10/1993 Kobayashi
5,263,432 A 11/1993 Davis
5,310,369 A 5/1994 Kobayashi
5,350,325 A 9/1994 Nanami
5,375,551 A 12/1994 Lunter et al.
5,377,610 A 1/1995 Goebel
5,421,753 A 6/1995 Roos
5,474,007 A 12/1995 Kobayashi
5,494,464 A 2/1996 Kobayashi et al.
5,607,332 A 3/1997 Kobayashi et al.
5,611,295 A 3/1997 Stables
5,718,611 A 2/1998 Schlangen et al.
5,755,601 A 5/1998 Jones
5,813,357 A 9/1998 Watson
6,032,605 A 3/2000 Takashima
6,086,437 A 7/2000 Murray Fig.20
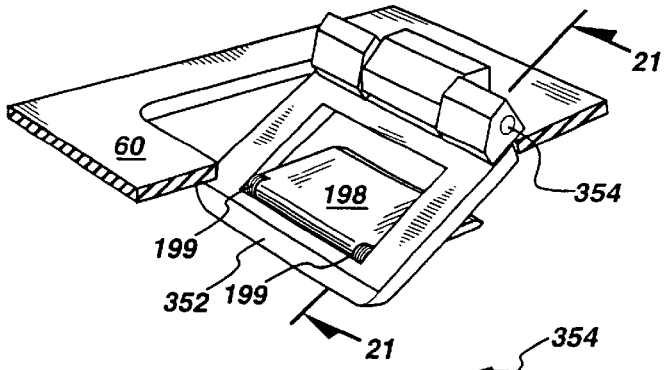
Fig.21
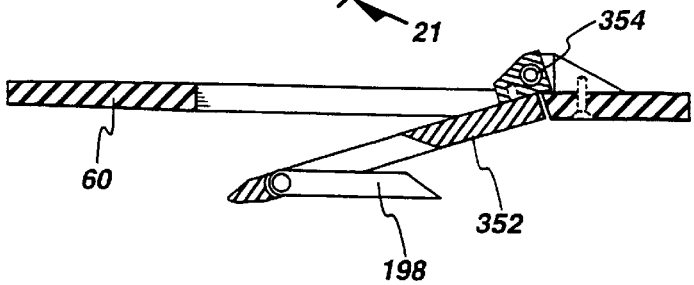
Fig.22
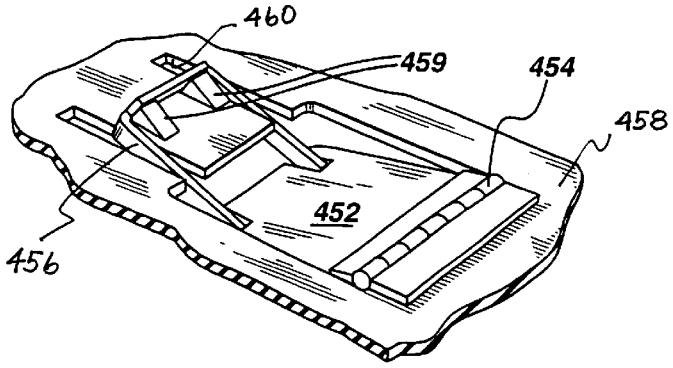
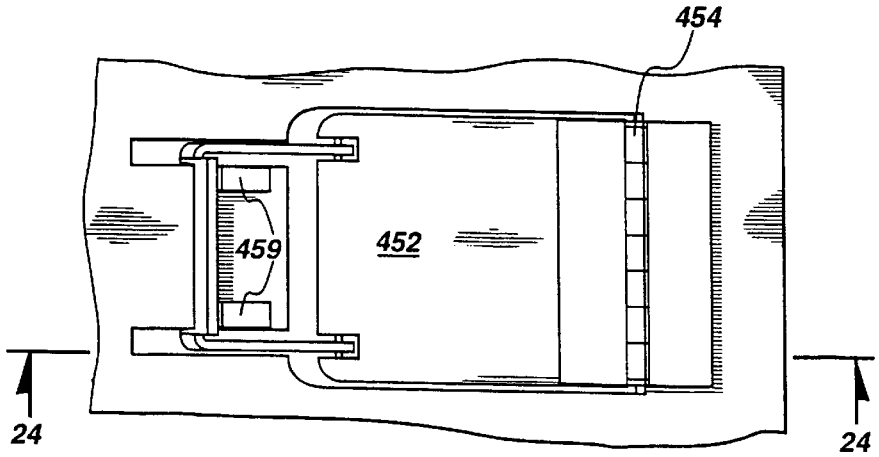
Fig.23

Fig.24
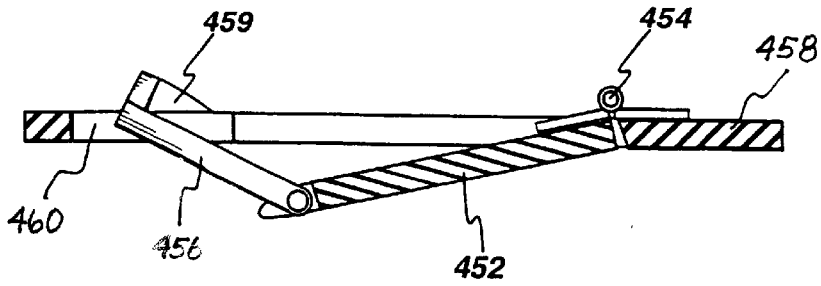
Fig.25
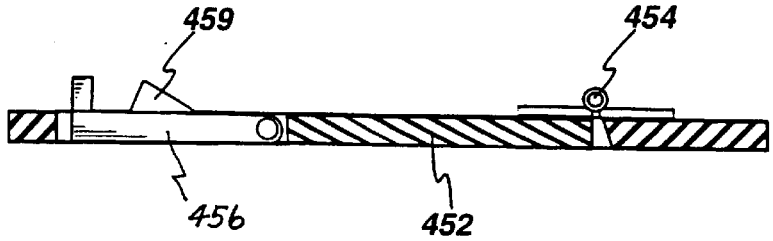
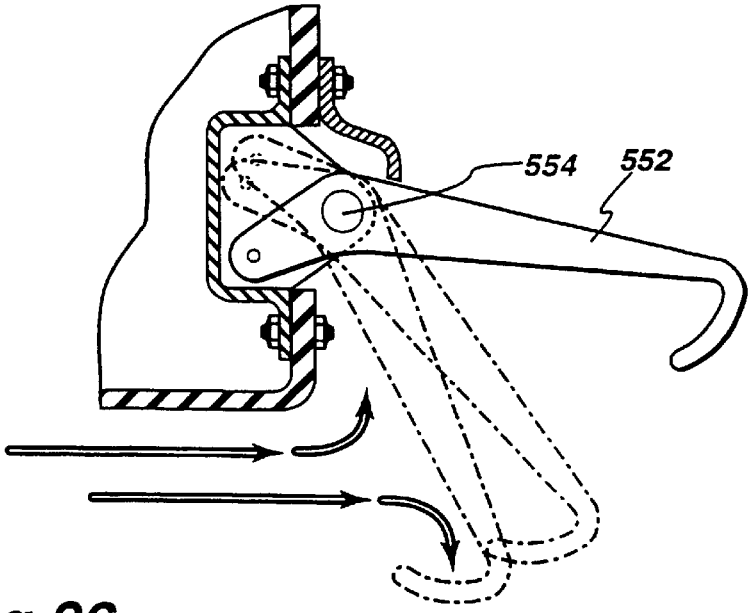
Fig.26

WATERCRAFT HAVING AUXILIARY STEERING

This application is a continuation of U.S. Ser. No. 09/759,456 filed Jan. 16, 2001, now abandoned, and which is a continuation of U.S. Ser. No. 09/088,854, filed Jun. 2, 1998 now U.S. Pat. No. 6,174,210. The entirety of these disclosures are incorporated by reference herein.

FIELD OF THE INVENTION

The present invention pertains to a watercraft control mechanism and, more particularly, to a watercraft control mechanism associated with steering, decelerating and trimming.

BACKGROUND OF THE INVENTION

In recent years, the demands of racers and recreational users alike for greater performance and maneuverability have driven the designers of personal watercraft to reconsider the control mechanisms traditionally used for steering, decelerating and trimming. In general, steering, decelerating and trimming can be achieved in a variety of manners, either independently of one another or synergistically.

Essentially, the steering of a boat can be achieved by either turning the source of propulsion, such as an outboard motor or a jet-boat nozzle, or by actuating the boat's control surfaces. These control surfaces can be substantially vertical such as the common rudder on a stem drive or they can be substantially horizontal, such as flaps and tabs. Examples of steering mechanisms involving vertical fins or rudders are found in U.S. Pat. Nos. 4,615,290, 4,632,049, and 4,352,666. Examples of steering mechanisms involving horizontal tabs or flaps are found in U.S. Pat. No. 5,193,478.

Decelerating can generally be accomplished in one of three ways: by reversing thrust, by redirecting the thrust toward the bow of the watercraft, or by creating drag by introducing a control surface that interferes with the flow of water past the watercraft. Decelerating by reversing thrust is perhaps the most common technique, simply requiring the propeller to turn backwards. The main problem associated with this technique is that decelerating is slow due to the time lag required to stop and then to reverse the propeller.

Redirecting the thrust toward the bow is a braking technique currently employed by numerous personal watercraft. Examples of thrust-reversing buckets or reverse gates are disclosed in U.S. Pat. Nos. 5,062,815, 5,474,007, 5,607,332, 5,494,464, and 5,154,650. Although these thrust-reversing buckets direct the water jet backwards, they also have a propensity to direct the water jet downwards. This downward propulsion lifts the stern of the watercraft and causes the bow to dive. The sudden plunging of the bow not only makes the watercraft susceptible to flooding and instability, but also makes it difficult for the rider to remain comfortably seated and firmly in control of the steering column.

U.S. Pat. No. 5,092,260 discloses a brake and control mechanism for personal watercraft involving a hinged, retractable flap mounted on each side of the hull capable of being angled into the water to slow the boat. However, when the actuator is extended, the flap pivots such that the trailing edge is lower than the leading edge, thereby creating an undesirable elevating force at the stern.

Trimming or stabilizing of a watercraft is normally achieved by adjusting the angle of the tabs mounted aft on the hull. Trim-tabs are used to alter the running attitude of the watercraft, to compensate for changes in weight distribution and to provide the hull with a larger surface for planing. Examples of trim-tab systems for watercraft are disclosed in U.S. Pat. Nos. 4,854,259, 4,961,396, and 4,323,027. Typically, these trim-tabs systems are actuated by electronic feedback control systems capable of sensing the boat's pitch and roll as well as wave conditions and then making appropriate adjustments to the trim-tabs to stabilize the boat.

Examples of trim-tab control systems are found in U.S. Pat. Nos. 5,263,432, 4,749,926, 4,759,732, and 4,908,766. The foregoing trim-tab mechanisms deflect the water downward and thus elevate the stern. The stabilizing system for watercraft disclosed in U.S. Pat. No. 4,967,682 attempts to address this problem by introducing a twin-tab mechanism capable of deflecting the flow of water under the hull either upwards or downwards to either elevate or lower the stern of the watercraft. Such a twin-tab mechanism, however, is designed expressly for stabilizing a watercraft and not for braking.

Steering, braking and trimming can also be performed synergistically. U.S. Pat. No. 5,193,478, noted above, discloses an adjustable brake and control flaps for steering, braking and trimming a watercraft. The flaps, located at the stern, act as powerful brakes for the boat in their fully declined position. Differential declination of the flaps results in trimming and steering of the boat. The flaps provide steering, braking and trimming in a manner analogous to the flaps and ailerons of an aircraft. During braking, however, the downward sweep of the tabs causes the stern to rise and the bow of the personal watercraft to plunge, often creating the potential for flooding and instability. Not only is the plunging of the bow uncomfortable for the rider, but the watercraft is more difficult to control during hard braking maneuvers.

Finally, U.S. Pat. No. 3,272,171 discloses a control and steering device for watercraft featuring a pair of vanes that can be pivotally opened below the hull of the watercraft to which they are mounted. The vanes are hinged at the ends closest to the stem and open toward the bow of the watercraft. As water is scooped by the opening vanes, the force of the water impinging on the vanes forces the vanes to open more. To prevent the vanes from being violently flung open against the underside of the watercraft, a ducting system is incorporated into the vanes to channel scooped water through the rear of the vanes to cushion the hull from the impact of the rear of the vanes. One of the shortcomings of this control mechanism, however, is that the scooping action of the vanes induces a great deal of turbulence on the underside of the watercraft especially when braking at high speeds. Second, the amount of water that is channeled through the ducts of the vanes is minimal and thus braking might, in some conditions, be too harsh. Third, the presence of the vanes (even when full retracted) and their associated attachment bases on the underside of the watercraft create drag at high speeds. Fourth, the vanes are not integrated with a main steering mechanism (such as a rudder or steerable nozzle) to provide better cornering. Fifth, the vanes may scoop up seaweed, flotsam or other objects floating in the water that could prevent the vanes from closing or clog the ducts in the vanes. Finally, closing the vanes when they are scooping water requires large gears whose weight causes the rear of the watercraft to sag.

Thus, there is a need for an improved watercraft control mechanism capable of steering, decelerating, and/or trimming a watercraft without causing the stem to elevate and the bow to plunge.

SUMMARY OF THE INVENTION

One aspect of embodiments of the present invention is to provide a mechanism for steering, decelerating, and/or trimming a watercraft without causing the stem of the watercraft to elevate and the bow to plunge, and to therefore enhance stability, control and comfort.

Another aspect of embodiments of the present invention is to provide an apparatus to steer a watercraft when the throttle is off and no steerable thrust is available.

An additional aspect of embodiments of the present invention is to provide an apparatus for steering, trimming, and/or decelerating a watercraft that can be stowed or retracted to reduce hydrodynamic drag at high speeds.

A further aspect of embodiments of the present invention is to provide an apparatus for steering, trimming, and/or decelerating a watercraft that resists clogging or jamming by seaweed, flotsam, or foreign objects floating in the water.

Also, an aspect of embodiments of the present invention is to provide an apparatus for decelerating a watercraft in a smooth and stable fashion when the watercraft is travelling at high speeds.

A preferred embodiment of this invention is directed to a watercraft comprising a hull having a bottom surface with a recess, and a tab retained in the recess flush with the bottom surface. The tab has a leading edge and a trailing edge. An actuator is coupled to the tab that selectively moves the tab out of and into the recess so that the tab is moved into a position out of the recess in which the leading edge of the tab is disposed in an upstream direction and tilted downwardly with respect to the trailing edge.

In another preferred embodiment of the invention, the watercraft has a longitudinal centerline and comprises a hull having a stern and a bottom surface. A pair of tabs are connected to the stern of the hull above the bottom surface, wherein each tab is connected to the stern to pivot about a pivot axis that is substantially parallel to the longitudinal axis. An actuator is coupled to each tab to selectively pivot each tab to move a portion of the tab to a position below the bottom surface.

Additionally, a preferred embodiment of the invention is directed to a watercraft comprising a hull having a stern and a bottom surface and a pair of tabs having a pivot end and a hooked end oriented toward the stern. The pivot end is connected to the stern to pivot about an axis substantially parallel to the stern. The tabs are connected to the stern above the bottom surface. An actuator is connected to the pair of tabs that selectively pivots each tab about the pivot end to selectively move the hooked end above and below the bottom surface.

The invention also relates to a control mechanism for a watercraft, comprising a steerable propulsion source, a steering controller for controlling the steerable propulsion source, and a linking member connected to the steering propulsion source at one end and having a slider disposed at another end. At least one tab having a bracket is connected to the slider disposed on the linking member. The slider translates with respect to the bracket. The tab is moveable between an inoperative position and an operative position whereby the tab can be angled such that, in the operative position and when the watercraft is traveling upright in water in a substantially forward direction, a volume of water impinges on a top surface of the tab thereby creating a downward and rearward force on the watercraft.

Other objects and features of the invention will become apparent by reference to the following description and drawings.

BRIEF DESCRIPTION OF THE DRAWINGS

A detailed description of preferred embodiments of the present invention is provided below with reference to the following drawings in which:

FIG. 20 is a perspective view of a variant of the tab having a spring-loaded flap of FIG. 14;

FIG. 21 is a side elevational view of the tab of FIG. 20 taken along line 21—21;

FIG. 22 is a perspective view of another variant of the tab of FIG. 14;

FIG. 23 is a top plan view of the tab of FIG. 22;

FIG. 24 is a cross-sectional view of the tab of FIG. 23 taken along line 24—24 in its closed position;

FIG. 25 is a cross-sectional view of the tab of FIG. 23 taken along line 24—24 in its closed position;

FIG. 26 is a side elevational view of a hooked tab capable of exerting a downward force on the stern of a watercraft when in contact with the water;

Figure 2:
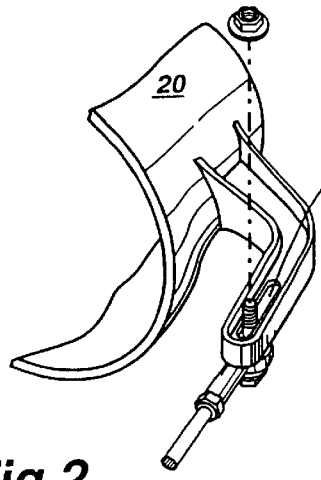
FIG. 2 is a partial perspective view of a variant of the nozzle arm of the watercraft control mechanism of FIG. 1.

In the drawings, preferred embodiments of the invention are illustrated by way of example. It is to be expressly understood that the description and drawings are only for purposes of illustration and to facilitate understanding, and are not intended to be a definition of the limits of the invention.

DETAILED DESCRIPTION OF PREFERRED EMBODIMENTS

Figure 3:
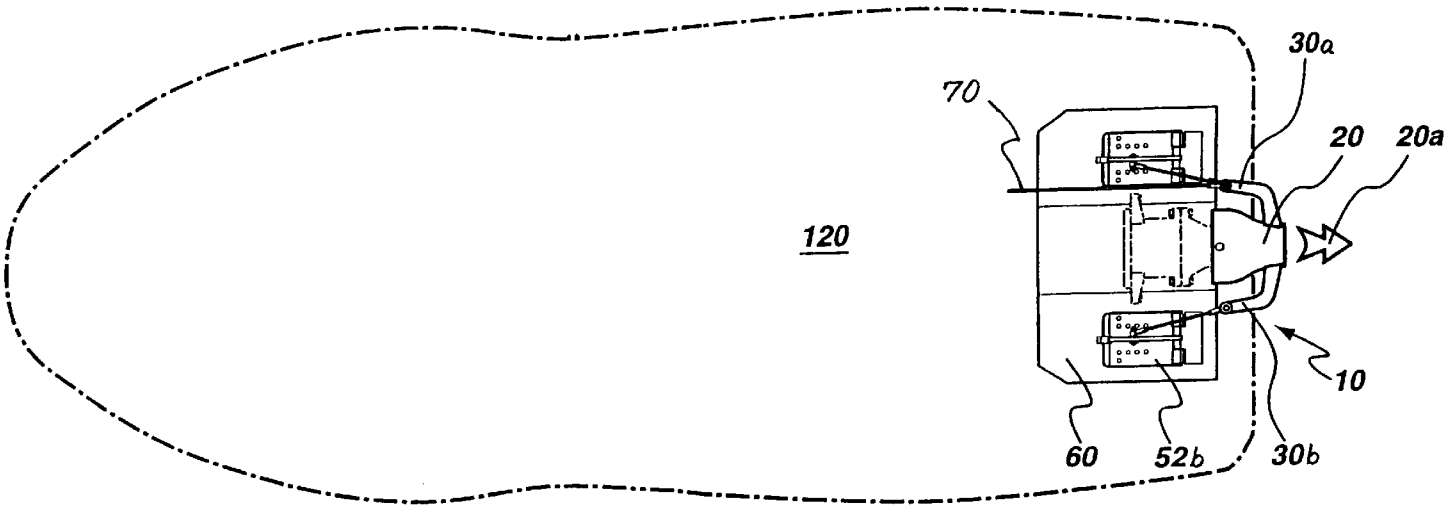
FIG. 3 is a top plan schematic view of a watercraft control mechanism with a watercraft shown stippled lines.
Figure 4:
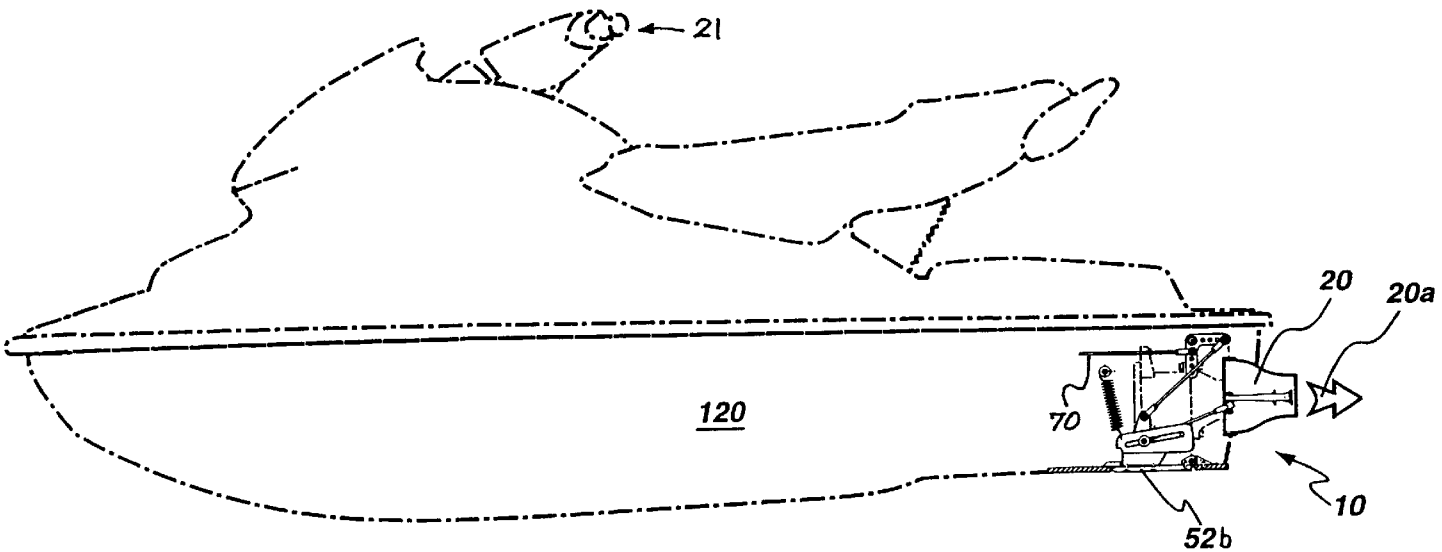
FIG. 4 is a side elevational view of a watercraft control mechanism of FIG. 3 with a watercraft shown in stippled lines.

This invention is shown and described as applied to a personal watercraft 120 (shown schematically in FIGS. 3 and 4, for example). However, this is for the purposes of illustration only and it will be understood by those of ordinary skill in the art that the control mechanisms described herein can be applied to many different types of watercraft, including for example, jet boats.

Figure 1:
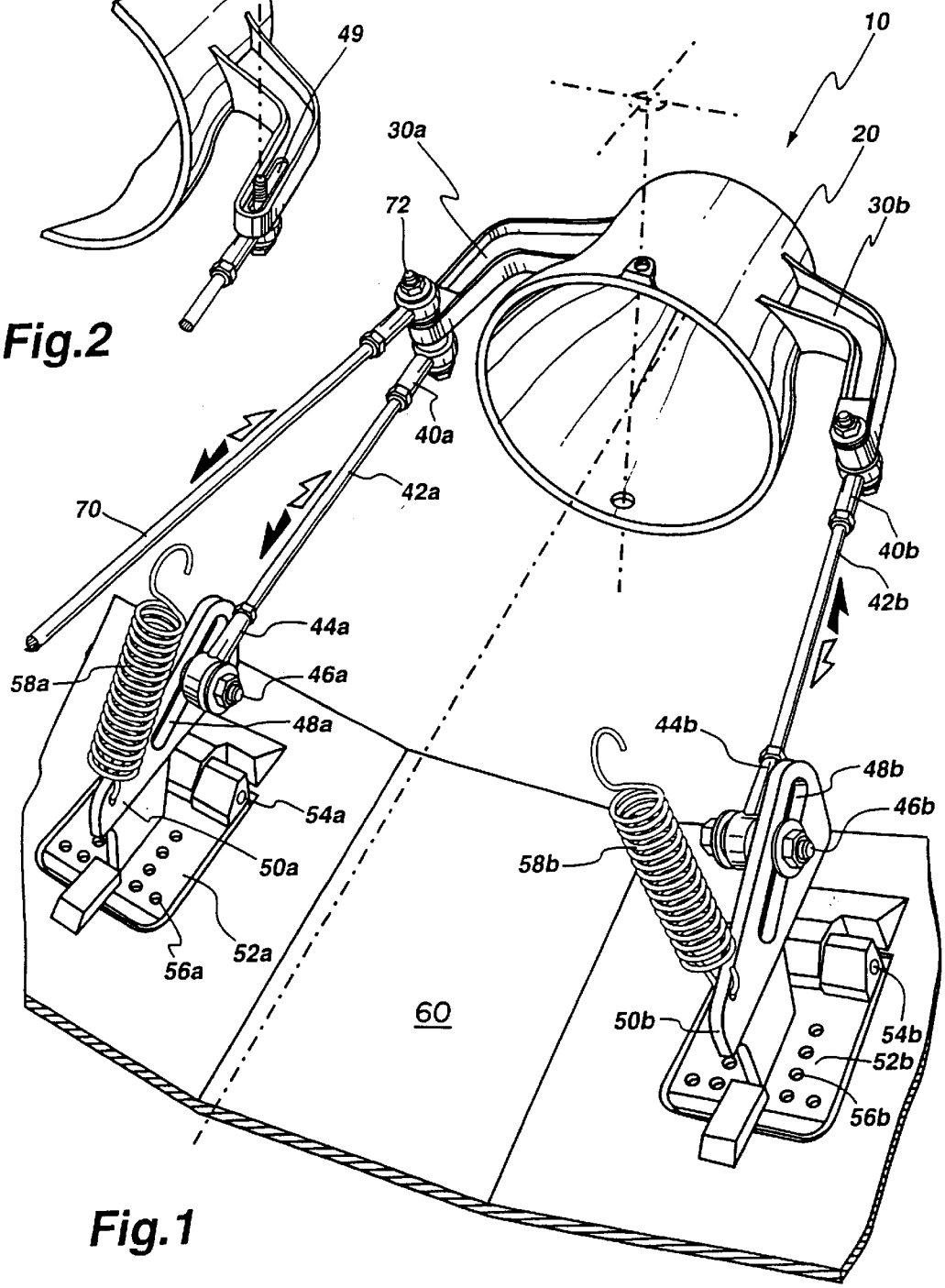
FIG. 1 is a partial perspective view of a watercraft control mechanism in accordance with an embodiment of the invention.

Referring to FIG. 1, a watercraft control mechanism 10 comprises a steerable nozzle 20 and a ride plate 60 located at the stem of the watercraft. As would be recognized by those of ordinary skill with watercraft, the nozzle 20 would typically be associated with a jet propulsion system. The nozzle 20 is disposed at the outlet of the jet propulsion system to selectively control and direct the thrust produced by the jet propulsion system that propels the 120 watercraft.

As described in detail below, the nozzle 20 is connected to the steering assembly 21 of the watercraft and also connects to the ride plate 60. A push-pull steering cable 70 is fixed to the starboard nozzle arm 30*a* at a steering joint 72. Push-pull steering assemblies are commonly known and are actuated by the driver operated steering control 21. Tabs 52 supported by the ride plate 60 are connected to the nozzle 20 as follows.

Attached to the steerable nozzle 20 is an L-shaped starboard nozzle arm 30*a* and an L-shaped port nozzle arm 30*b*. A spherical rod-end bearing 40*a* connects the starboard nozzle arm 30*a* to a starboard rod 42*a*. Symmetrically, a spherical rod-end bearing 40*b* connects the port nozzle arm 30*b* to a port rod 42*b*. The starboard rod 42*a* is connected to a reactive spherical rod-end bearing 44*a*, while the port rod 42*b* is also connected to a reactive spherical rod-end bearing 44*b*. The reactive spherical rod-end bearings 44*a* and 44*b* are fastened to a starboard slider 46*a* and to a port slider 46*b*.

The starboard slider 46*a* is constrained to translate within a starboard slot 48*a*, which is machined from a starboard tab bracket 50*a*. Similarly, the port slider 46*b* is constrained to translate within a port slot 48*b*, which is machined from a port tab bracket 50*b*. The starboard tab bracket 50*a* is attached to a starboard tab 52*a*. The starboard tab 52*a* is connected to a ride plate 60 by a hinge 54*a*. Similarly, the port tab bracket 50*b* is fixed to a port tab 52*b*, which is connected to the ride plate 60 by a hinge 54*b*.

The tabs 52*a* and 52*b* are disposed with a plurality of holes 56*a* and 56*b* to dissipate the pressure gradient that might arise at high speeds (due to the Bernoulli effect) between the top side of the tab and the underside. Springs 58*a* and 58*b* are connected at one end to the top sides of the starboard tab bracket 50*a* and the port tab bracket 50*b*, respectively, and at the other end to the hull of the watercraft.

As can be understood in FIGS. 3 and 4, to operate the watercraft control mechanism 10, the driver simply actuates the push-pull steering cable 70 which causes the steerable nozzle 20 to turn. As the steerable nozzle 20 turns, the starboard slider 46*a* and the port slider 46*b* translate in opposite directions within the starboard slot 48*a* and the port slot 48*b*, respectively. To turn to starboard, for example, the push-pull steering cable 70 is pulled toward the bow, causing the steerable nozzle 20 to deflect towards starboard, creating a primary steering effect. As the steerable nozzle 20 turns to starboard, the starboard nozzle arm 30*a* exerts a force on the starboard rod 42*a* via the spherical rod-end bearing 40*a* which causes the reactive spherical rod-end bearing 44*a* and the starboard slider 46*a* to translate within the starboard slot 48*a*. When the starboard slider 46*a* contacts the front-lower end of the starboard slot 48*a*, the starboard slider 46*a* then exerts a force on the starboard tab bracket 50*a*. The force exerted on the starboard tab bracket 50*a* causes the starboard tab 52*a* to pivot about the hinge 54*a* and to decline below the ride plate 60. The declination of the starboard tab 52*a* induces a drag on the starboard side which creates a secondary steering effect.

The summation of the primary steering effect due to the turning of the steerable nozzle 20 and the secondary steering effect due to the tab drag produces steering superior to what could be attained with the nozzle alone. When the steerable nozzle 20 is returned towards its neutral, centered position, the starboard slider 46*a* stops exerting a downward force on the starboard tab bracket 50*a* and the starboard tab 52*a*, and water pressure returns the starboard tab 52*a* to its neutral position with the help of the spring 58*a*. A decelerator cable (not shown in FIG. 1) can be used to simultaneously actuate the tabs 52*a* and 52*b*, creating a balanced drag force underneath the ride plate 60.

Alternatively, as shown in FIG. 2, the starboard nozzle arm 30*a* and the port nozzle arm 30*b* may have a slot 49. The purpose of the slots is to create non-proportional actuation of the tabs 52*a* and 52*b*. It should be apparent to one of ordinary skill in the art that the push-pull steering cable can be equivalently mounted on the port nozzle arm or on a separate steering arm rigidly connected to the steerable nozzle 20. Furthermore, it should also be apparent to one of ordinary skill in the art that two pull-only cables mounted to both the starboard nozzle arm 30*a* and the port nozzle arm 30*b* would achieve the same objective. Pneumatic or hydraulic actuators, solenoids or mechanical linkages could function in a manner equivalent to the push-pull cable illustrated in FIG. 1.

The techniques required for fabrication of the watercraft control mechanism 10 in accordance with the invention would be well-known to a person of ordinary skill in the art. Materials appropriate for the tabs and mechanical linkages would be aluminum, stainless steel, titanium or any alloy that is non-corrosive in sea water. The steerable nozzle, due to its complex curvatures, would best be molded from a high-strength plastic fiber-reinforced polymer or equivalent.

Figure 5:
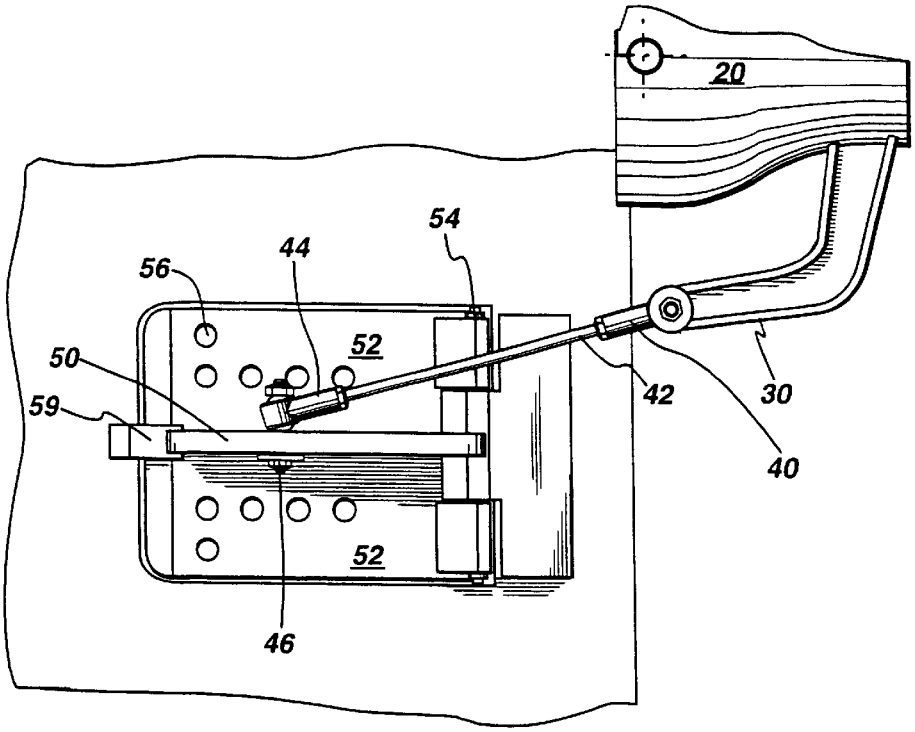
FIG. 5 is a top plan view of the watercraft control mechanism showing the deceleration cable mechanism.
Figure 6:
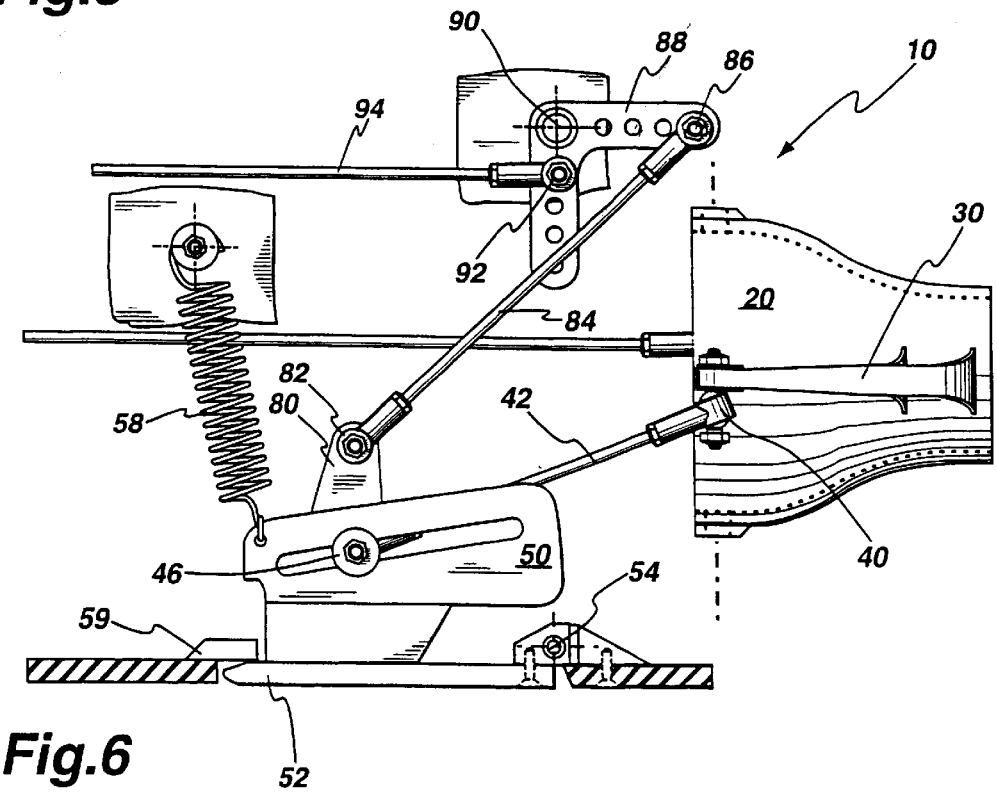
FIG. 6 is a side elevational view of a watercraft control mechanism of FIG. 5.

Referring to FIGS. 5 and 6, which show the port and starboard elements generically in a preferred embodiment, the watercraft control mechanism 10 further comprises stoppers 59 to limit the travel of the tabs 52. Each tab bracket 50 has a vertical extension 80 which supports a joint 82. A decelerator linkage 84 links an L-arm 88 via an upper joint 86 to the vertical extension 80 at a lower joint 82. The L-arm 88 is fixed to the watercraft at a fixation point 90. A decelerator cable 94 is linked to the L-arm 88 at a decelerator cable joint 92. When the decelerator cable 94 is pulled, the L-arm 88 pivots about the fixation point 90, causing the upper joint 86 to exert a downward force on the tab bracket 80 via the decelerator linkage 84 and the lower joint 82. The tab bracket 80 transfers the downward force to the tab 52, which then pivots about the hinge 54. The tab 52 declines into the water until a shoulder of the tab bracket 50 collides with the upper surface of the stopper 59. When the tension in the decelerator cable 94 is released, the spring 58 returns the tab 52 to its neutral position wherein the tab 52 is in contact with the lower surface of the stopper 59. The stoppers 59 and deceleration linkage 84 are optional.

The angle of attack of the tabs is believed to be important in optimizing the sucking effect necessary to keep the stern of the watercraft well in the water during deceleration. For instance, while an angle of attack of 15 degrees may provide near-optimal downward force at the stern, an increase of only ten degrees in the angle of attack of the tabs to 25 degrees could radically diminish the downward force at the stern of the watercraft.

Figure 7:
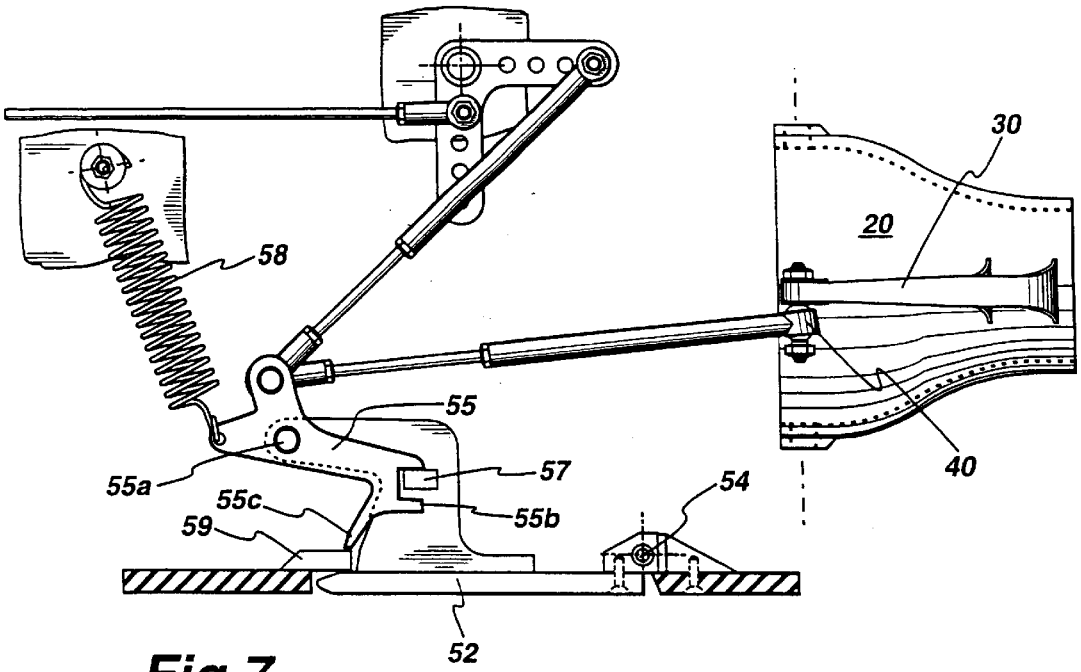
FIG. 7 is a side elevational view of another embodiment of the watercraft control mechanism, illustrating the use of telescopic linkages.

Another embodiment of the watercraft control mechanism 10, illustrated in FIG. 7, comprises a pivot lock 55 and a lock stopper 57 to ensure that the tab 52 remains flush and that accidental opening of the tab 52 does not occur. The spring 58 exerts an upward force on the pivot lock 55. During either deceleration or steering, the pivot lock 55 rotates about a pivot 55*a*, urging an arm 55*b* of the pivot lock 55 to sweep upwards into contact with the lock stopper 57. This causes a lower extension 55*c* of the pivot lock 55 to unlock the stopper 59, thereby enabling the tab 52 to pivot freely about the hinge 54. When deceleration or steering ceases, the spring 58, which is under tension, urges the tab 52 back to its neutral position (i.e. flush with the ride plate 60). The spring 58 may also be assisted by reversing the load on the deceleration cable 94 or on the push-pull steering cable 70. As the tab 52 returns to its position flush with the ride plate 60, the lower extension contacts the stopper 59, and the lock stopper 57 contacts the pivot lock 55 as shown in FIG. 7, thereby locking the tab 52 and preventing the tab 52 from opening accidentally.

Figure 9:
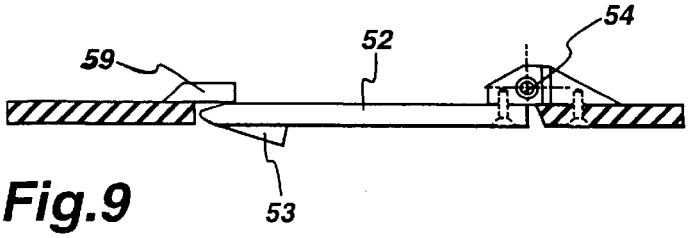
FIG. 9 shows a side elevational view of the tab of FIG. 8 taken along line 9—9.
Figure 8:
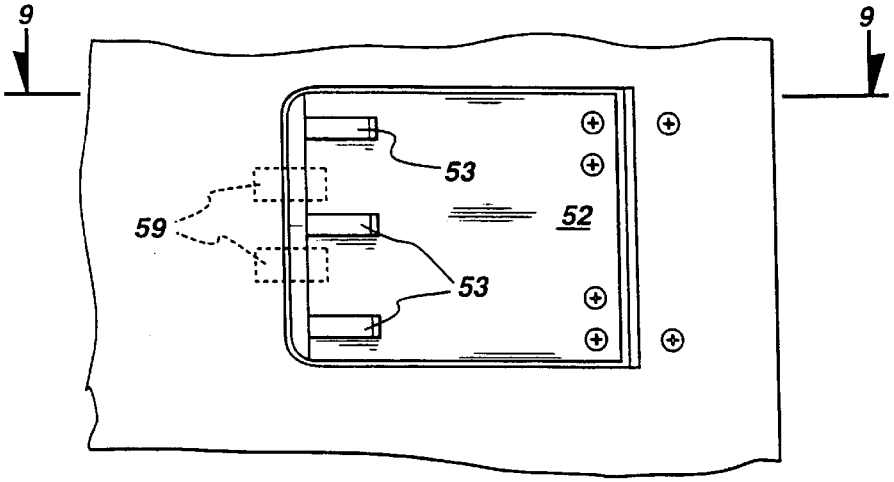
FIG. 8 shows a typical tab in accordance with the invention.

A variant of the tab 52, illustrated in FIGS. 8 and 9, also resists accidental opening. The tab 52 comprises three ramps 53 mounted on the underside of the tab 52. The three ramps 53 exert an upward force on the tab 52 at high speeds to ensure that the tab 52 remains flush and that no accidental or unexpected opening of the tabs occurs at high speeds. Of course, any combination of these features can be used, such as ramps 53 with the lock 55.

Figure 10:
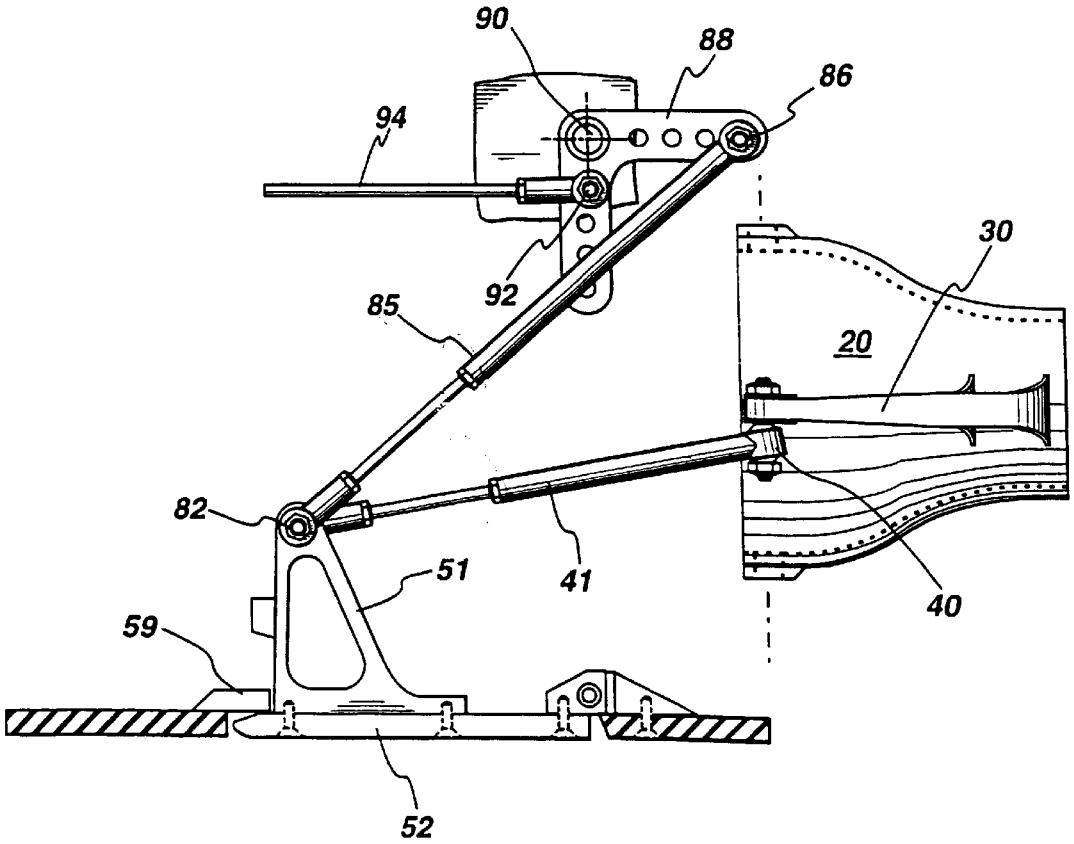
FIG. 10 shows a side view of an alternative embodiment of a watercraft control mechanism having a pivot lock.

A variant of the watercraft control mechanism, illustrated in FIG. 10, decelerates and assists with steering and comprises a steerable nozzle 20, nozzle arms 30, and spherical rod-end bearings 40. Each spherical rod-end bearing is connected to one extremity of a telescopic link 41, the other extremity of the telescopic link 41 being connected to the lower joint 82 fixed to a tab bracket 51. Also connected to the tab bracket 51 at the lower joint 82 is telescopic decelerator linkage 85, which is connected to the L-arm 88 at the upper joint 86. The L-arm 88 is attached to the watercraft at the fixation point 90. The decelerator cable 94 is joined to the L-arm 88 at the decelerator cable joint 92. When the decelerator cable 94 is pulled, the L-arm 88 pivots about the fixation point 90, causing the telescopic decelerator linkage 85 to exert a generally downward force on the tab bracket 51. The downward force exerted on the tab bracket 51 causes the tab 52 to pivot downward about the hinge 54 until the tab bracket 51 collides with the stopper 59. The declination of both tabs 52*a* and 52*b* decelerates the watercraft 120.

When the steerable nozzle 20 is turned, the nozzle arm 30 exerts a force on the telescopic link 41 through the spherical rod-end bearing 40. The force exerted on the telescopic link 41 causes the telescopic link 41 to compress until the telescopic link 41 runs out of travel at which point the telescopic link begins to transfer the force to the tab bracket 51 via the lower joint 82. The force exerted on the tab bracket 51 causes the tab 52 to sweep downwards about the hinge 54 until the stopper 59 collides with the tab bracket 51. Actuation of either starboard tab 52*a* or port tab 52*b* induces an offset drag force (i.e. offset with respect to the plane of symmetry of the watercraft), which creates a steering effect additional to that resulting from the steerable nozzle 20.

Figure 12:
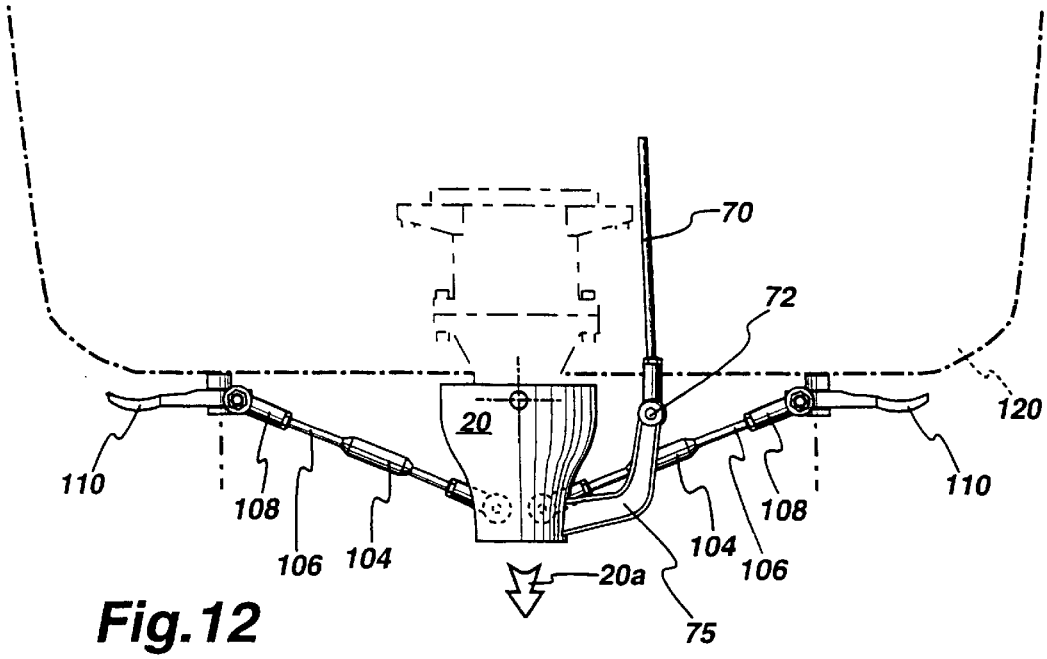
FIG 12 is a top plan view of the embodiment of the watercraft control of FIG. 11.
Figure 11:
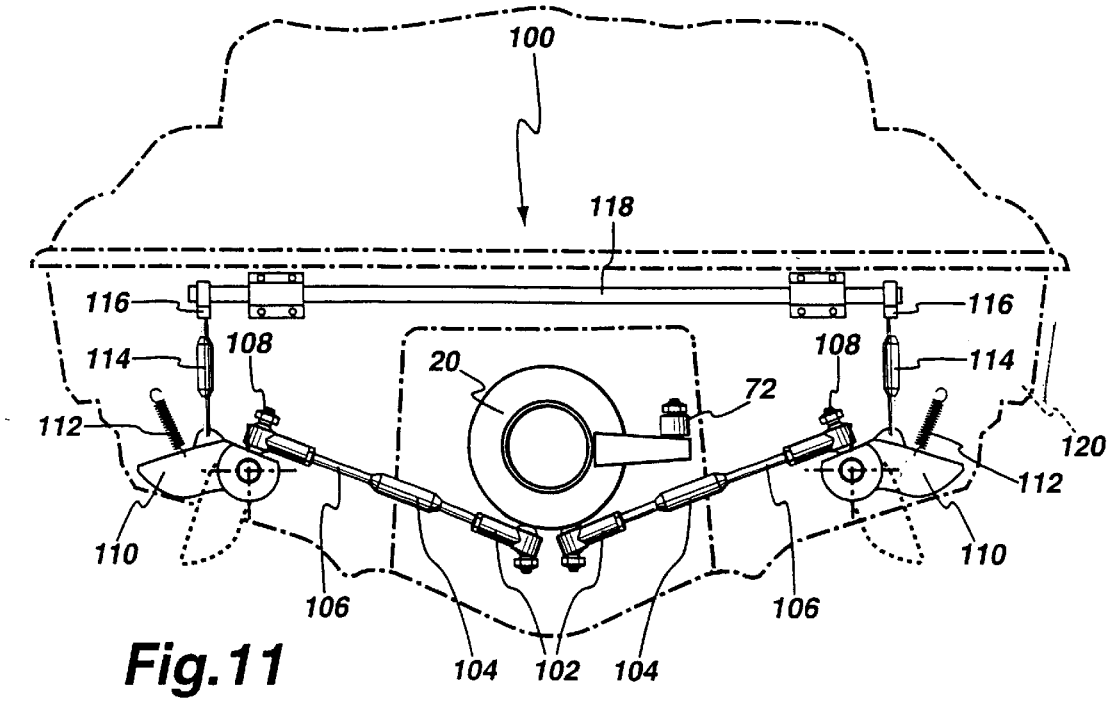
FIG. 11 is a rear elevational view of another embodiment of the watercraft control mechanism.

Referring to FIGS. 11 and 12, an alternative embodiment of a watercraft control mechanism 100 uses tabs 110 disposed on the stern of the watercraft 120. The control mechanism 100 comprises a steerable nozzle 20, a steering arm 75, a steering joint 72 and a push-pull steering cable 70. The steerable nozzle 20 is connected to a pair of spherical rodend bearings 102. Each spherical rod-end bearing 102 is joined to a transverse damper 104 and a transverse linkage 106, each of which is angled substantially perpendicularly to the thrust vector 20*a* of the steerable nozzle 20. Ball joints 108 link the transverse linkages 106 to tabs 110. Springs 112, vertical dampers 114 and vertical linkages 116 connect the tabs 110 to a transom bar 118 mounted transversely along on the stern 120 of the watercraft.

In operation, the nozzle 20 is turned by the steering control 21 via steering cable 70, which moves the transverse linkages 106. Due to the joints 102 and 108, movement of the linkages 106 cause the respective tab 110 to pivot downwardly. The associated spring 112 pulls the tab 110 upward above the bottom of the hull of the watercraft 120 when the nozzle 20 is turned back, i.e., after the turn is completed. The dampers 114, which are supported by the vertical linkages 116, translate with transom bar 118 as the nozzle 20 turns to be positioned above the tabs 110. The dampers 114 control movement of the tabs 110 so that movement of the watercraft 120 and slight movement of the nozzle 20 does not cause the tabs 110 to spring up and down below the hull to create undesired interference in the flow of water.

Figure 13:
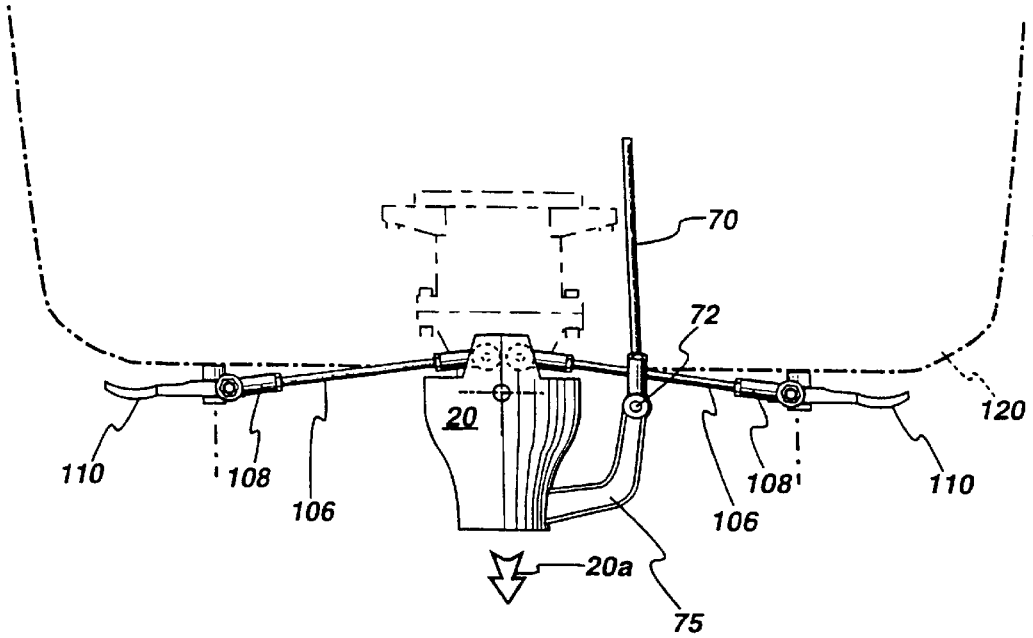
FIG. 13 is a top plan view of a variant of the embodiment of FIG. 12.

FIG. 13 illustrates a variant of the embodiment shown in FIGS. 11 and 12. In the variant of FIG. 13, the transverse linkages 106 are mounted to the steerable nozzle 20 near the nozzle's inlet while, in FIGS. 11 and 12, the transverse linkages 106 are mounted to the steerable nozzle 20 near the nozzle's outlet. When the transverse linkages 106 are attached to the steerable nozzle 20 near the nozzle inlet (as in FIGS. 11 and 12), a given angular displacement of the steerable nozzle 20 results in a small displacement of the tabs 110. When the transverse linkages 106 are attached to the steerable nozzle 20 near the nozzle outlet, a given angular displacement of the steerable nozzle 20 results in a comparatively larger displacement of the tabs 110.

Figure 14:
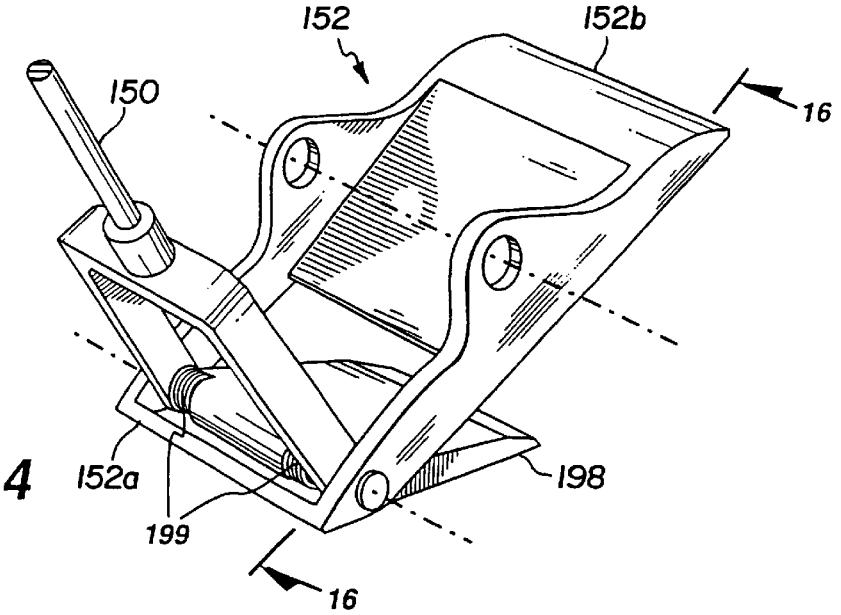
FIG. 14 is an enlarged perspective view of a tab for a watercraft control having a spring-loaded flap.
Figure 15:
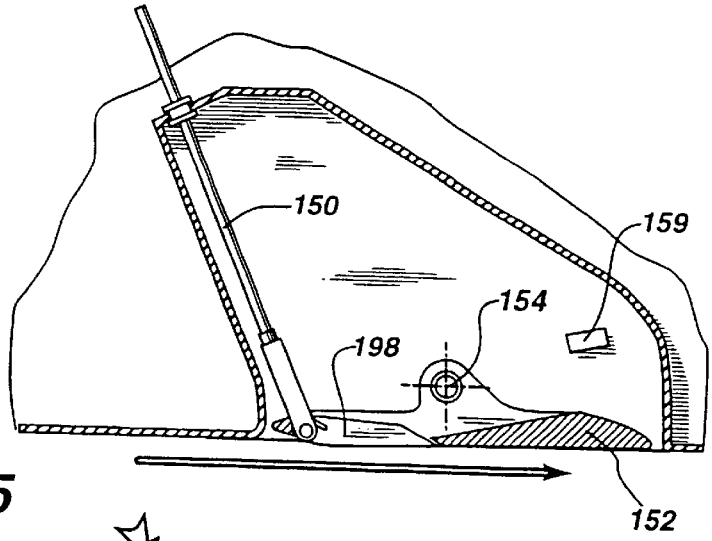
FIG. 15 is a side elevational view of the tab of FIG. 14 shown in its neutral position flush with the ride plate.
Figure 16:
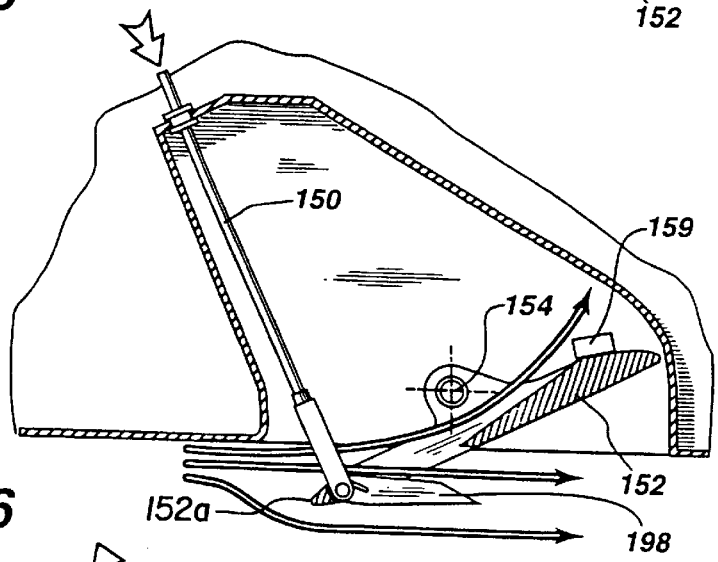
FIG. 16 is a side elevational view of the tab of FIG. 15 taken along line 16—16 shown in its decelerating position with its leading edge declined into the flow and the spring-loaded flap open.
Figure 17:
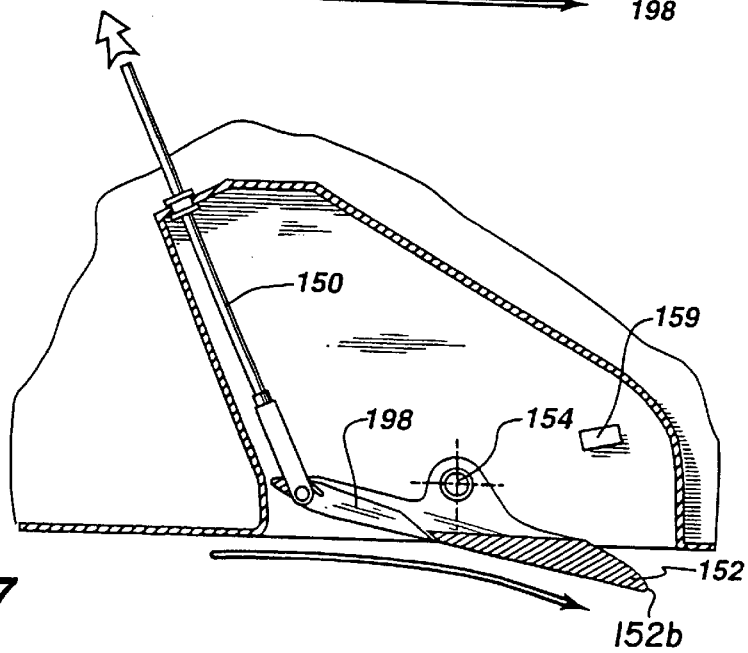
FIG. 17 is a side elevational view of the tab of FIG. 15 shown in its trimming position with its trailing edge declined into the flow.

Referring to FIGS. 14, 15, 16 and 17, tab 152 is shown that is a variant of a tab 52. Tabs 152 have a control linkage 150 activated by the driver, which can be separate or combined with the steering assembly 21. A pivot 154, seen in FIGS. 15–17, is fixed to the watercraft and allows tab 152 to freely rotate. A stopper 159 is also attached to the watercraft. The tab 152 further comprises a spring-loaded flap 198 and rotational springs 199.

FIG. 15 shows a neutral operating position. When the control linkage 150 is actuated for deceleration, a downward force is exerted on the leading edge 152*a* of the tab 152, causing the tab 152 to rotate about the pivot 154 until the rear of the tab collides with the stopper 159 as seen in FIG. 16. When the leading edge 152*a* is inclined into the water, deceleration of the watercraft occurs. At high speeds, the momentum of the water colliding with the tab 152 can induce large tensile stresses in the control linkage 150 and may also provide deceleration that is too severe. In order to alleviate the substantial drag of the tab 152 at high speeds, the tab 152 comprises a spring-loaded flap 198 which opens at high speeds as illustrated in FIGS. 14 and 16. The spring-loaded flap 198 is pinned to the tab 152 and preferably restrained by two rotational springs 199. When the momentum of the water colliding with the exposed portion of the tab 152 is decreased as the watercraft slows, the rotational springs 199 urge the spring-loaded flap back to its neutral position, flush with the bottom surface of the tab 152. When the tab 152 is returned to its neutral position as shown in FIG. 15, the control linkage 150 exerts on upward force on the tab 152 near the leading edge 152*a,* thereby causing the tab 152 to rotate about the pivot 154 until the tab 152 reaches its neutral position.

For trimming, as seen in FIG. 17, the control linkage 150 exerts an upward force on the tab 152 near the leading edge 152*a,* thereby causing the tab 152 to rotate about the pivot 154 such that the trailing edge 152*b* declines into the water. The flap 198 remains neutral. To return the tab 152 to the neutral position of FIG. 15, downward force is exerted on the tab 152 until it reaches the neutral position.

Figure 18:
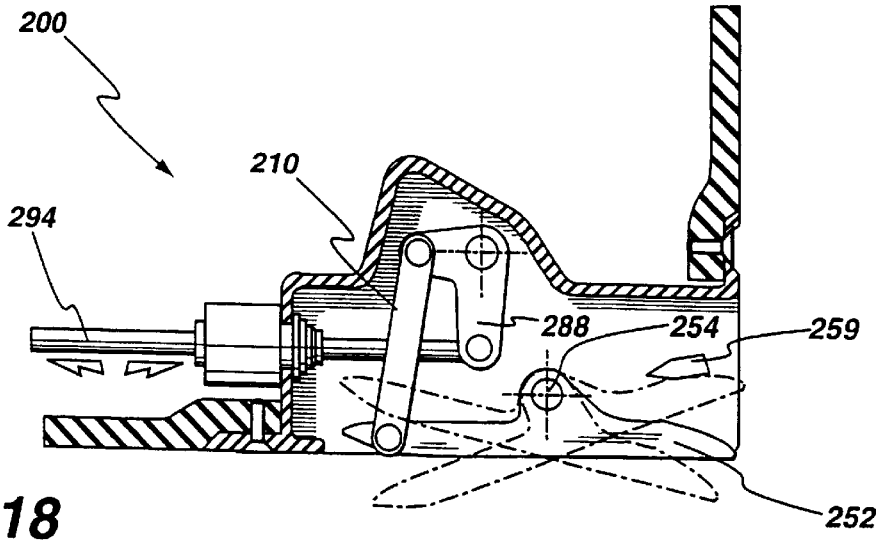
FIG. 18 is a side elevational view of a trim-tab mounted flush-fitted underneath the hull at the stern of the watercraft.
Figure 19:
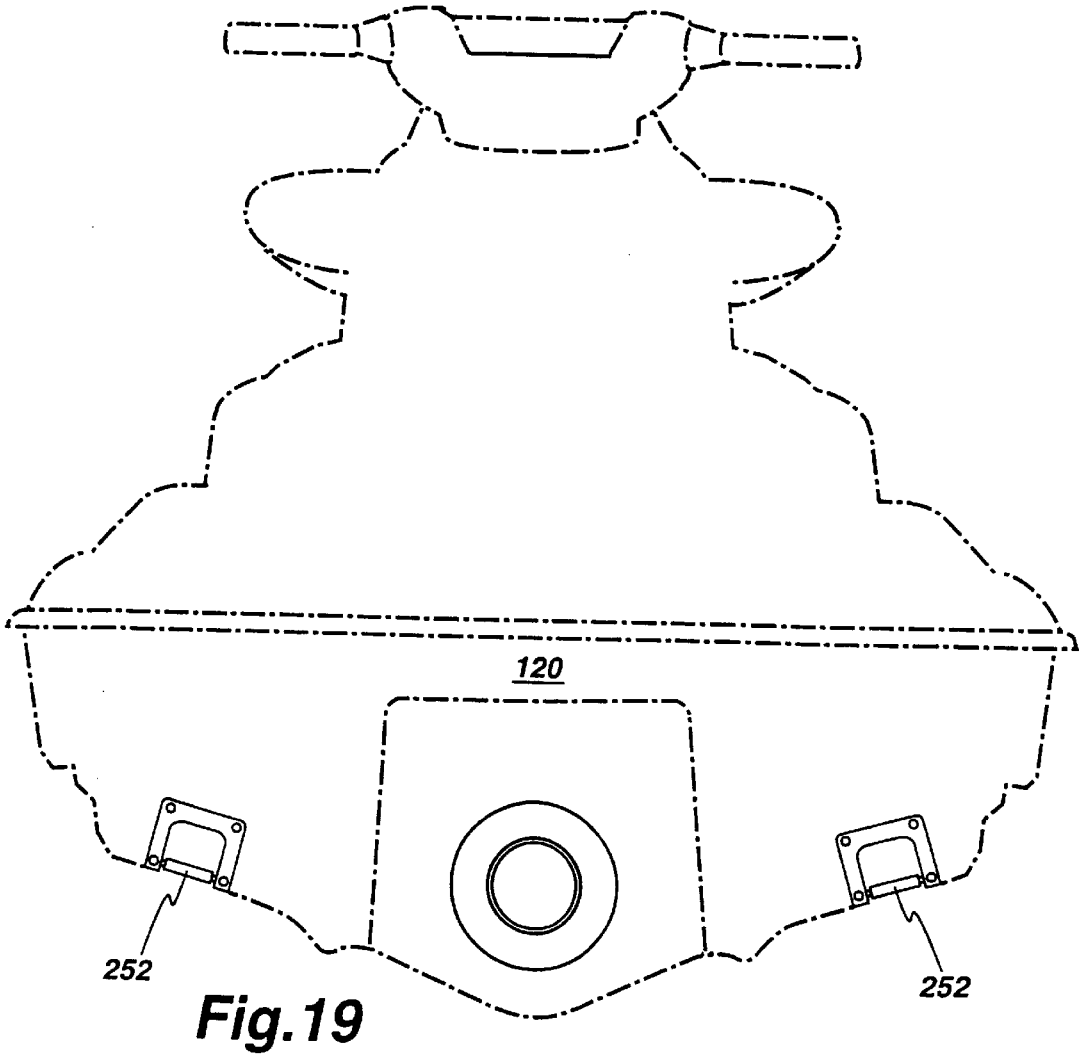
FIG. 19 is a rear view illustrating the integration of the flush-fitted trim-tabs of FIG. 18 to the hull.

FIGS. 18 and 19 illustrate another embodiment of a watercraft control mechanism 200. A tab 252 is flush-fitted with the hull of the watercraft 120. This is especially advantageous for personal watercraft which are often beached or travel in very shallow water. The watercraft control mechanism 200 includes an actuation linkage 294, which is generally parallel to the tab 252 in its neutral (flush) position. The watercraft control mechanism 200 further includes a vertical link 210 capable of exerting a generally vertical force on the tab 252 near its leading edge. The watercraft control mechanism further includes an L-arm 288 capable of pivoting about a point fixed to the watercraft hull and capable of converting the generally horizontal force exerted by the actuation linkage 294 to a generally vertical force onto the tab 252. In addition, the watercraft control mechanism includes a stopper 259 to limit the declination of the tab 252. In operation, generally horizontal forces exerted upon the L-arm 288 by the actuation linkage 294 cause either the leading edge or the trailing edge of the tab 252 to contact the water, thereby creating drag for steering, deceleration or trimming. Again, the actuation linkage 294 can be a separate operator control or associated with the steering assemble 21.

FIGS. 20 and 21 illustrate another embodiment of a tab 352 for use in a watercraft control mechanism as disclosed herein. The tab 352, which has the spring-loaded flap 198 described above, is shown mounted integrally with the ride plate 60. The tab 352 pivots about a hinge 354. At high speeds, if the momentum of the water impinging on the exposed portion of the tab 352 exceeds the torque exerted by the rotational springs 199 on the spring-loaded flap 198, then the spring-loaded flap 198 opens and alleviates the pressure acting on the tab 352. Thus attenuates the tensile stresses in the actuation linkage (not shown).

FIGS. 22 and 23 illustrate a tab 452 which is a variant of tab 352. Tab 452 comprises a pivoting handle 456 that extends from the leading edge. The ride plate 458 has a pair of grooves 460 in which the handle 456 slides. A pair of stoppers 459 are attached to the ride plate 458 that limit the range of declination of the tab 452 as it pivots about the hinge 454. FIGS. 24 and 25 show the tab 452 in its open configuration and in its closed configuration, respectively.

FIG. 26 illustrates a hooked tab 552, a:variant of tab 52, that rotates about a pivot 554 positioned at the stem of the watercraft. Unlike the flat prior art tabs that sweep downward from the stern of the watercraft and cause the stern to lift, the hooked tab 552 catches the water and sucks the watercraft downward. The hooked tab 552 would be actuated by an actuation linkage similar to the actuation linkages shown in FIGS. 14–17.

Figure 27:
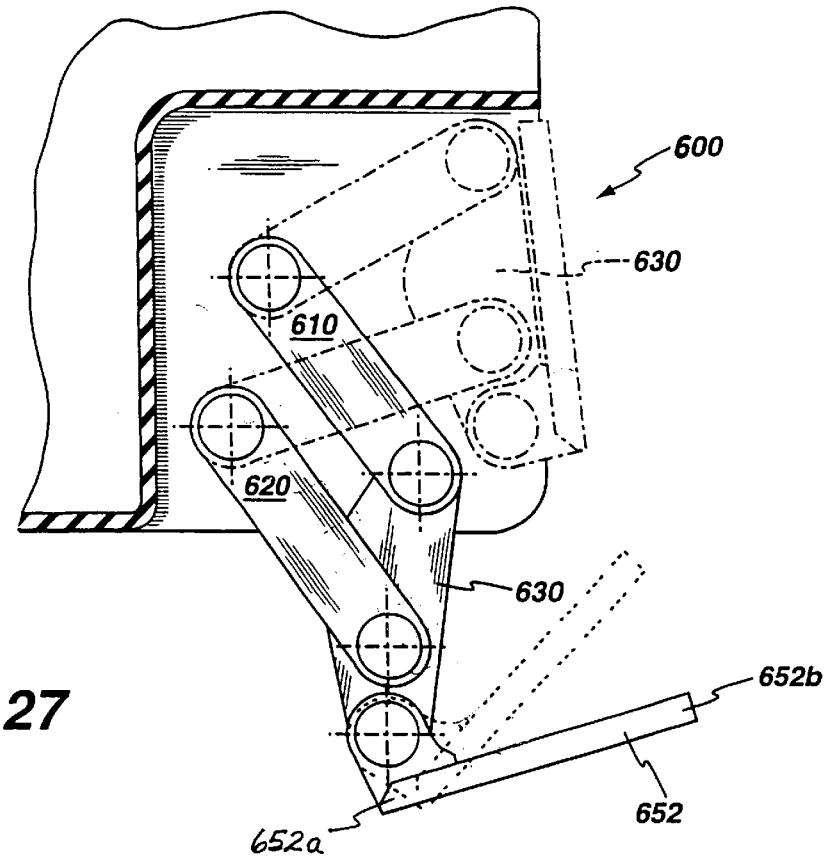
FIG. 27 is a side elevational view of another embodiment of a pivoting watercraft mechanism shown in its deployed configuration and in its retracted configuration.

FIG. 27 illustrates yet another embodiment of the watercraft control mechanism 600. A tab 652 is supported by a linkage comprising a first arm 610 and a second arm 620, which are generally parallel to one another, and connected by a transverse link 630. Arms 610 and 620 are pivotally mounted preferably to the stern of the watercraft. The tab 652 is pivotally connected to one end of the transverse link 630 near the leading edge 652*a* of the tab 652. Linear or rotational actuators can be used to displace the arms 610 and 620 and then to vary the angle of attack of the tab 652. In its stowed position (shown in stippled lines), the tab 652 is well above the waterline. When deployed, the arms 610 and 620 swing downward. The leading edge of the tab 652*a* can be inclined into the water (by an actuator not shown in FIG. 27) thereby creating a drag force to either steer or decelerate the watercraft. Alternatively, the trailing edge 652*b* of the tab 652 can be dipped into the water to trim the watercraft.

One of the main advantages of the embodiment illustrated in FIG. 27 is its capacity to stow the tab and its associated mechanism safely above the bottom of the hull so that a watercraft featuring such a watercraft control mechanism could be beached or used in extremely shallow water without risk of damaging the exposed parts of the watercraft control mechanism.

Figure 28:
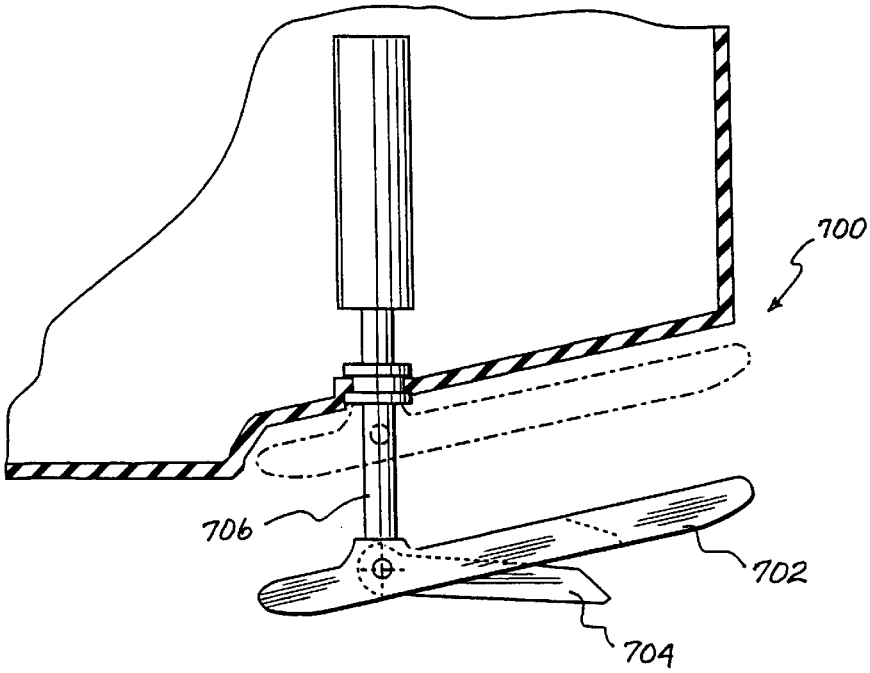
FIG. 28 is a side elevational view of another embodiment of a translational watercraft control mechanism shown in its deployed position and in its retracted position.

Illustrated in FIG. 28 is a watercraft control mechanism 700 whose tab or tabs 702 are fixed at an angle of inclination of approximately 15 degrees. Tabs 702 have flaps 704. Such a watercraft control mechanism could be used only for steering or decelerating, and not for trimming. The tab or tabs 702 are translated from a retracted or stowed position (as shown in dotted lines) to an operative or submerged position (as shown in solid lines) by one or more linear actuators. Although FIG. 28 presents a simple vertically-oriented actuator 706, it should be known to those skilled in the art that there are many equivalent mechanisms that could be just as easily implemented for raising and lowering the tab or tabs. It should also be noted that the determination of the optimal angle of inclination of the tabs 702 as well as a hydrodynamically optimal tab profile are merely matters of routine experimentation.

Figure 29:
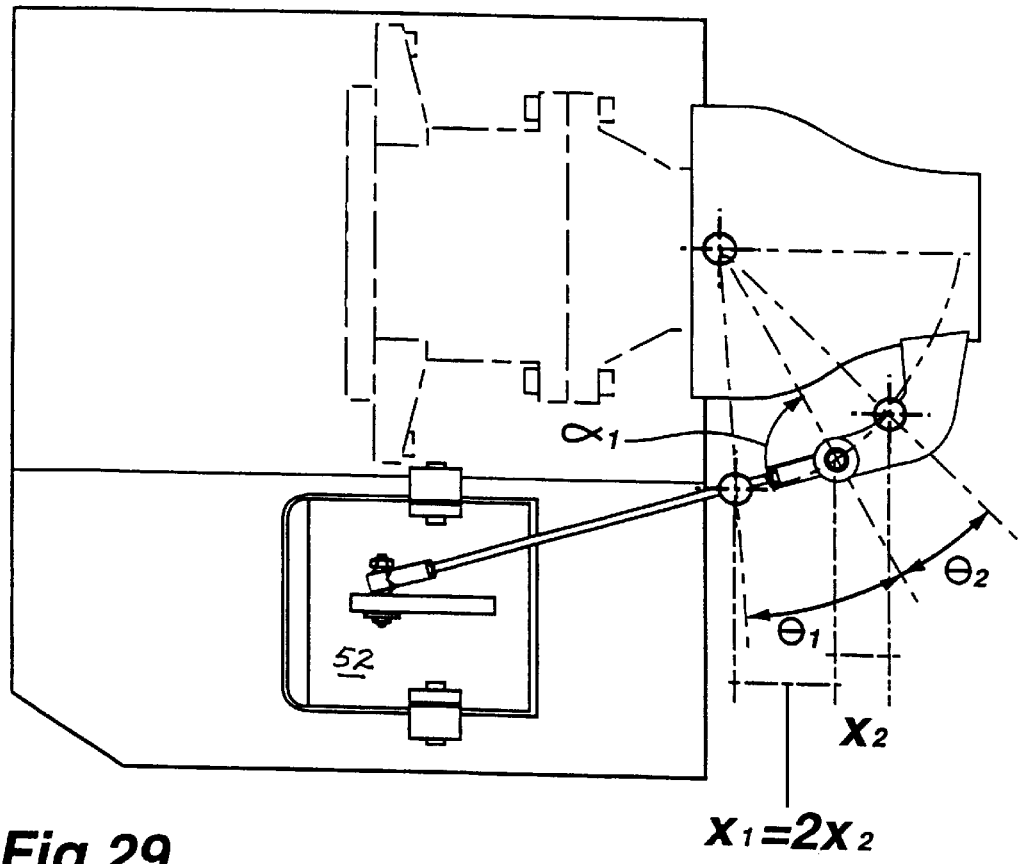
FIG. 29 is a geometric analysis in a plan view showing how the motion of the tabs is coupled to that of the nozzle when the point of fixation is offset on the nozzle.
Figure 30:
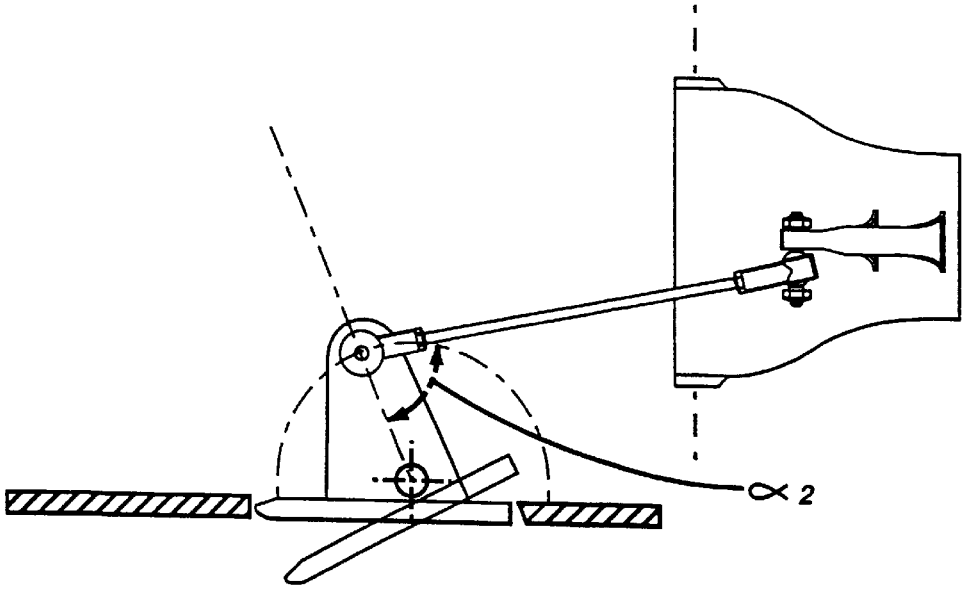
FIG. 30 is a side view of the geometric analysis of FIG. 29.
Figure 31:
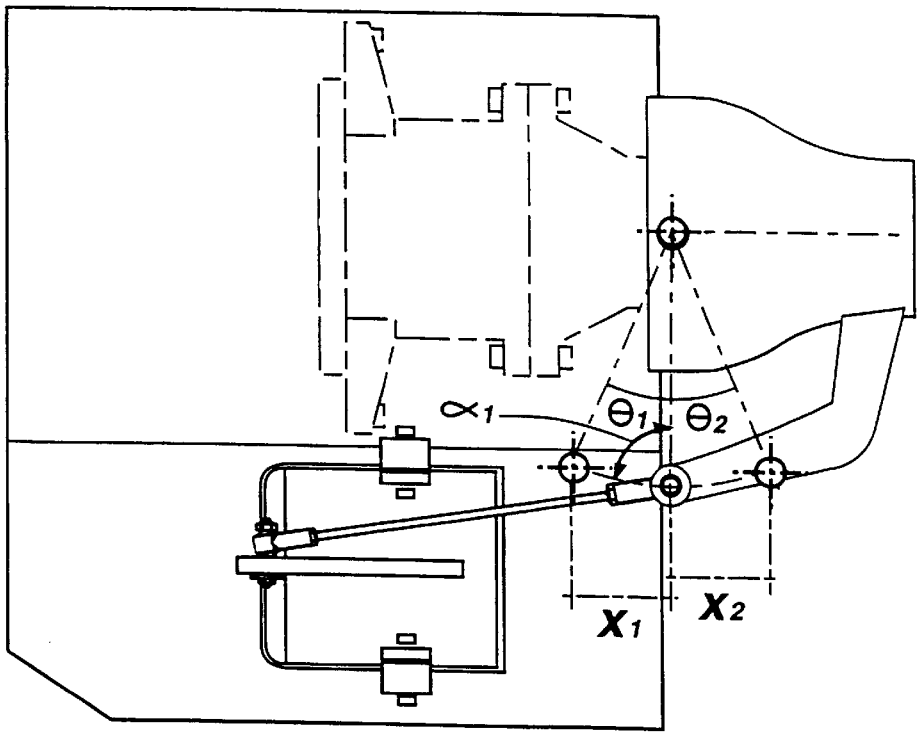
FIG. 31 is another geometric analysis in a plan view showing how the motion of the tabs is coupled to that of the nozzle when the point of fixation is offset on the tabs.
Figure 32:
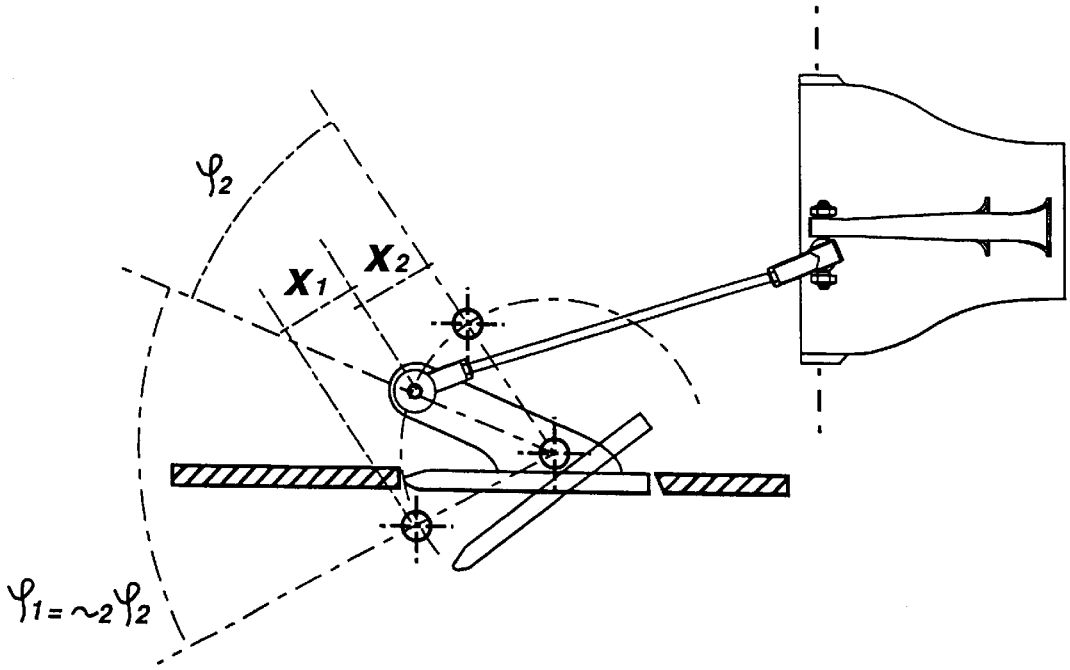
FIG. 32 is a side view of the geometric analysis of FIG. 31.

FIGS. 29, 30, 31 and 32 schematically illustrate how it is possible to achieve a non-proportional actuation of the tabs 52. FIGS. 29 and 30 show an actuating linkage fixed to a nozzle arm such that it is offset from the axis of rotation of the nozzle. FIGS. 31 and 32 show an actuating linkage fixed to a tab 52 such that it is offset from the pivot axis of the tab 52. In FIGS. 29 and 30, an angular displacement of the port nozzle arm results in the actuating linkage traveling twice as far when the port nozzle arm is turned to port than when it is turned to starboard. In FIGS. 31 and 32, the actuating linkage fixed to the port nozzle arm travels equal distances but, due to the offset fixation of the actuating linkage on the tab, the angular displacement of the tab is twice as large in declination as it is in inclination.

Each of the foregoing embodiments of the watercraft control mechanism preferentially employs two tabs (as illustrated in FIGS. 1, 3 and 19) in order to steer the watercraft. It would be apparent to one of ordinary skill in the art that in lieu of two tabs, the watercraft control mechanism could equivalently have four or six or any even number of tabs. Activating three smaller tabs on the starboard side, for instance, would therefore be essentially the same as activating a single large tab on the starboard side. Furthermore, the watercraft control mechanism could be equipped with an odd number of tabs with one central tab straddling the plane of symmetry of the boat so that the central tab would perform strictly a decelerating role, contributing nothing to the steering. Another possible variant of the embodiments presented above would be to employ a single, central tab for deceleration purposes only.

Another embodiment of the watercraft control mechanism not shown in the drawings would entail an electronic feedback control system capable of sensing the angle of the steerable nozzle, degree of decelerator cable actuation as well as watercraft speed, pitch, roll and wave conditions. Such an electronic control system would be able to activate solenoids or electric motors to make rapid and precise adjustments to the angle of the tabs in relation to the input parameters. Furthermore, in the foregoing description of preferred embodiments, it would be obvious to one of ordinary skill in the art that many of the mechanical components and sub-systems, chosen for their mechanical simplicity and reliability could be replaced by more complex, albeit functionally equivalent, component and sub-systems involving solenoids or electric motors.

Therefore, the above description of preferred embodiments should not be interpreted in a limiting manner since other variations, modifications and refinements are possible within the spirit and scope of the present invention. The scope of the invention is defined in the appended claims and their equivalents.

What is claimed is:

1. A watercraft comprising:

a hull having a bottom surface with a recess;

a tab retained in the recess flush with the bottom surface, wherein the tab has a leading edge and a trailing edge; and an actuator coupled to the tab that selectively moves the tab out of and into the recess so that the tab is moved into a position out of the recess in which the leading edge of the tab is disposed in an upstream direction and tilted downwardly with respect to the trailing edge.

2. The watercraft of claim 1, further comprising a ride plate attached to the hull to create the bottom surface, wherein the tab is flush with the ride plate when within the recess.

3. The watercraft of claim 2, wherein the tab is pivotally connected to the ride plate.

4. The watercraft of claim 1, wherein the actuator is a linear actuator.

5. The watercraft of claim 1, wherein the tab has an opening therein through which water flows when the tab is moved out of the recess.

6. The watercraft of claim 1, further comprising a biasing mechanism that moves the tab into the recess.

7. The watercraft of claim 6, wherein the biasing mechanism comprises a spring.

8. The watercraft of claim 6, wherein the biasing mechanism comprises at least one ramp on a bottom surface of the tab.

9. The watercraft of claim 1, further comprising a stopping mechanism supported by the hull that interacts with the tab to limit movement of the tab.

10. The watercraft of claim 1, further comprising a steerable propulsion source supported by the hull, wherein the actuator comprises a link that is controlled by the steerable propulsion source.

11. The watercraft of claim 10, wherein the actuator further comprises a deceleration link controlled by a deceleration control mechanism.

12. The watercraft of claim 1, further comprising a deceleration controller and a steering controller, wherein the actuator is coupled to both the deceleration controller and the steering controller.

13. The watercraft of claim 1, wherein the tab has a pivoting flap secured thereto.

14. The watercraft of claim 13, wherein the flap is connected to the tab near the leading edge.

15. The watercraft of claim 1, wherein the recess has walls and the tab is pivotally connected to a wall of the recess.

16. The watercraft of claim 1, wherein the actuator comprises a multi-piece linkage.

17. A watercraft having a longitudinal centerline comprising:

a hull having a stem and a bottom surface;

a pair of tabs connected to the stem of the hull above the bottom surface, wherein each tab is connected to the stem to pivot about a pivot axis that is substantially parallel to the longitudinal axis; and an actuator coupled to each tab to selectively pivot each tab to move a portion of the tab to a position below the bottom surface.

18. The watercraft of claim 17, further comprising a steerable propulsion source, wherein the actuator is connected to and controlled by the steerable propulsion source.

19. The watercraft of claim 17, wherein the actuator selectively pivots the tabs separately and in unison.

20. A watercraft comprising:

a hull having a stern and a bottom surface;

a pair of tabs having a pivot end and a hooked end oriented toward the stem, the pivot end being connected to the stem to pivot about an axis substantially parallel to the stern, wherein the tabs are connected to the stern above the bottom surface; and an actuator connected to the pair of tabs that selectively pivots each tab about the pivot end to selectively move the hooked end above and below the bottom surface.

21. The watercraft of claim 20, further comprising a steerable propulsion source, wherein the actuator is connected to and controlled by the steerable propulsion source.

22. The watercraft of claim 20, wherein the actuator selectively moves the tabs separately and in unison.

23. A control mechanism for a watercraft, said mechanism comprising:

(a) a steerable propulsion source;

(b) a steering controller for controlling said steerable propulsion source;

(c) a linking member connected to said steering propulsion source at one end and having a slider disposed at another end; and (d) at least one tab having a bracket that is connected to said slider disposed on said linking member, wherein said slider translates with respect to said bracket and said at least one tab is moveable between an inoperative position and an operative position whereby said at least one tab can be angled such that, in the operative position and when said watercraft is traveling upright in water in a substantially forward direction, a volume of water impinges on a top surface of said at least one tab thereby creating a downward and rearward force on said watercraft.

* * * * *